United States Patent [19]

Vezzani

[11] Patent Number: 4,557,190

[45] Date of Patent: Dec. 10, 1985

[54] APPARATUS FOR COMPACTING SCRAP MATERIALS, SUCH AS RELATIVELY COMMINUTED SCRAP METAL, WASTE, AND THE LIKE

[75] Inventor: Luciano Vezzani, Ovada, Italy

[73] Assignee: Officine Vezzani S.p.A., Milan, Italy

[21] Appl. No.: 589,438

[22] Filed: Mar. 14, 1984

[30] Foreign Application Priority Data

Mar. 31, 1983 [IT] Italy ..... 20417 A/83

[51] Int. Cl.[4] ..... B30B 9/32

[52] U.S. Cl. ..... 100/98 R; 100/215; 100/218; 100/232; 100/249; 100/265

[58] Field of Search ..... 150/98 R, 218, 232, 150/215, 249, 250, 251, 265; 29/1 B, 403.1, 403.2, 403.3

[56] References Cited

U.S. PATENT DOCUMENTS

| | | | |
|---|---|---|---|
| 1,026,987 | 5/1912 | Kardos | 100/232 X |
| 1,033,091 | 7/1912 | Dunn . | |
| 2,362,701 | 11/1944 | Koehring | 100/232 X |
| 2,748,694 | 6/1956 | Thompson | 100/232 |
| 3,129,656 | 4/1964 | Judd . | |
| 3,564,993 | 2/1971 | Tezuka | 100/232 X |

FOREIGN PATENT DOCUMENTS

| | | | |
|---|---|---|---|
| 2027401 | 12/1971 | Fed. Rep. of Germany | 100/232 |
| 2702344 | 8/1977 | Fed. Rep. of Germany . | |
| 0026476 | 3/1978 | Japan | 100/232 |

*Primary Examiner*—Billy J. Wilhite

*Attorney, Agent, or Firm*—Guido Modiano; Albert Josif

[57] ABSTRACT

To compact such scrap materials as relatively comminuted chip, waste, and the like, an apparatus is provided which comprises a vertically extending briguetting machine, upstream whereof there is provided at least one horizontal pre-compression device. The briquetting machine has a portal-like configuration and a vertical compacting ram arranged to penetrate a side intake feed chamber and a vertical axis die. A closure anvil is movable under the die. The die is mounted with a small clearance in the die holder and has an indentation along one generatrix of the outer surface. Thus, the die will be ruptured along the generatrix line during the compression stroke. This does not jeopardize functionality but rather makes die replacement easier. The vertical arrangement eliminates eccentric wear as due to the weight of the horizontally moving elements of known briquetting machines, and facilitates the intaking of the pre-compressed material.

20 Claims, 13 Drawing Figures

11a
11
7
11
8
11a
12
13
13
14
IV
V
1
4
3
2
IV
5
34
35
35
6
10
23
8
24
25
31
11
7
14
22
12
17
15
16
19
21
9
18
18
20
30
30
V

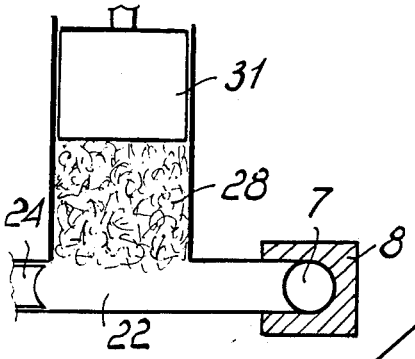
Fig.6a
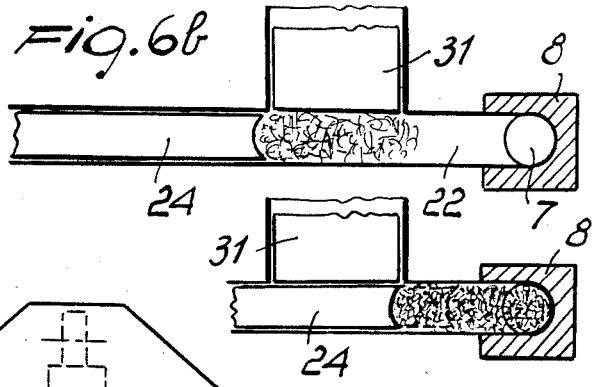
Fig.6b
Fig.6c
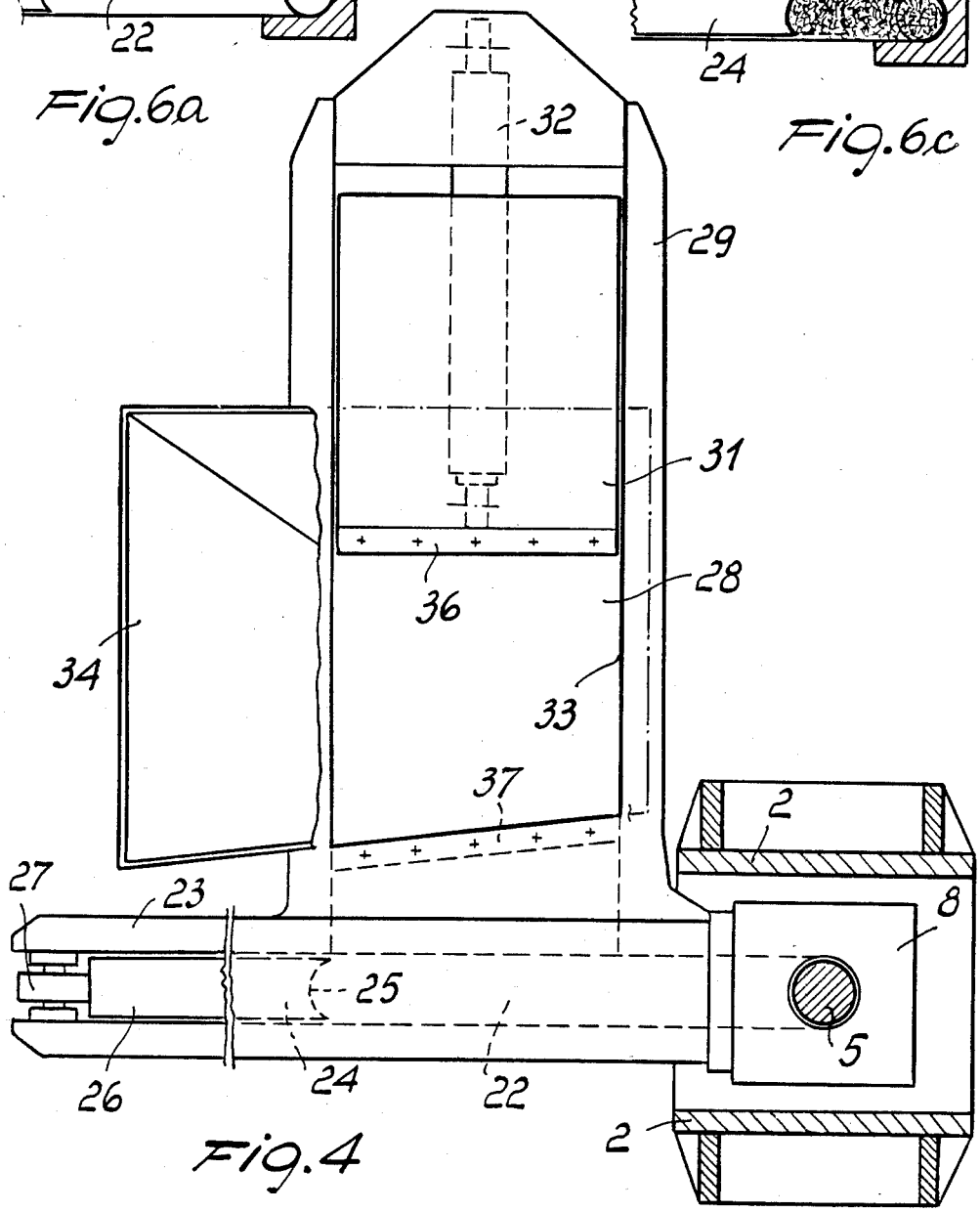
Fig.4

1
2
5
8
19
9
24
35
37
34
28
36
31
29
32
30
17
16
18
7
15
34'

APPARATUS FOR COMPACTING SCRAP MATERIALS, SUCH AS RELATIVELY COMMINUTED SCRAP METAL, WASTE, AND THE LIKE

BACKGROUND OF THE INVENTION

This invention relates to an apparatus for compacting scrap materials, such as relatively comminuted scrap metal, waste, and the like.

It is known that waste material compacting, e.g. the compacting of metal and non-metal scraps, chip, machining waste, and other similar materials in small sizes, is traditionally effected by means of so-called briquetting machines, which compress the material into a block or briquet form. Such briquetting machines essentially comprise a feed chamber, whereinto a material to be processed is introduced by gravity, and a horizontally extending compression chamber located directly downstream of the feed chamber. A hydraulically operated ram is horizontally slidable within the two chambers which pushes the material from the feed chamber into the compression chamber, and presses the material at a very high pressure against an anvil which closes the compression chamber, thus reducing the material into a block or briquet of high density. The pressed material is then removed either by taking the anvil away or appropriately displacing the die which defines the compression chamber.

Such apparata have an important operating limitation due to their ability to accept only sufficiently comminuted materials. In particular, they cannot process long chip (whose length exceeds two centimeters), which require a preliminary crushing step at a specially provided plant, if the ram and die are to suffer no damage. Conventional apparata are also unable to process light or needle-like chip, which tends to hang up and does not fall readily into the feed chamber, thus interfering with a smooth material feeding.

Further, such machines are liable to intense wear of the parts in relative motion, and particularly of the ram and die, and especially to uneven wear owing to the weight load being applied entirely on one portion of the stationary structure. Additional problems are encountered with the die, which is force fitted in its seat in order to withstand the very high pressures to which it is subjected. This involves considerable difficulties when the die is to be replaced periodically.

SUMMARY OF THE INVENTION

It is a primary object of this invention to provide an apparatus for compacting scrap materials, such as relatively comminuted scrap metal, chip, waste, and the like, which can obviate the drawbacks and limitations of prior apparata as described above, and can operate with a wider range of waste materials, while affording longer life of its parts, in particular those subjected to peak pressure values.

A further object of the invention is to provide an apparatus as indicated, wherein the die replacement may be effected not only at longer time intervals than with conventional apparata, but also more rapidly and with less difficulty.

These and other objects, such as will be apparent hereinafter, are achieved by an apparatus for compacting scrap materials, such as relatively comminuted scrap metal, waste, and the like, comprising a feed chamber for a material to be processed, a material compression chamber located downstream of said feed chamber, and a compacting ram for pressing said material from said feed chamber into said compression chamber, said compression chamber being defined by a die and movable closure means at the die outlet, the apparatus being characterized in that said compression chamber and compacting ram are arranged with the axis thereof substantially vertical, and that upstream of said feed chamber there is provided at least one pre-compression chamber extending substantially horizontally.

With an apparatus of this type, compaction of the material within the die occurs in a vertical direction, which not only enables the ram weight to be put to use as well for downward compression, but also avoids uneven wear of the parts which are more subjected to pressure forces, since the ram weight is now applied on the material and not on horizontal sliding surfaces. Moreover, vertical compaction allows the material introduction port to the compacting area to be located at a higher level, which results advantageously in compression chambers being disposable without problems, because the increased height favors the intaking of the material into the chambers even if the material does not happen to be comminuted so much as with conventional briquetting machines. With the latter machines, in fact, owing to such limiting factors as the low height of the horizontal ram section and hence of the briquet, any pre-compression carried out upstream would require a low and wide pre-compression chamber, which makes the introduction of the material into the chamber difficult. Advantageously, the provision of one or more pre-compression chambers upstream of the feed chamber of the inventive apparatus also enables a shearing means to be added for the material portion which is being fed into the pre-compression chamber(s), thereby relatively large size and/or long materials may be processed which reaches the briquetting machine proper in such a form as to create no problems of wear and damage to the die or the ram.

Advantageously, with the inventive apparatus, the die is not force fitted in the die holder, but rather arranged with a more loose fit. Further, it may be formed with a weakened longitudinal zone which, as the material is being compressed, is ruptured along one generatrix line, so that the die, which remains supported with a vertical axis, will be relatively expansible horizontally and can be quickly replaced with quite simple operations.

BRIEF DESCRIPTION OF THE DRAWINGS

Further details and advantages of the invention will be more clearly understood from the following detailed description of two preferred, though not exclusive, embodiments thereof, with reference to the accompanying illustrative drawings, where:

FIG. 4 is a plan sectional view of this apparatus, as taken along the line IV—IV of FIG. 1;

FIGS. 6*a*, 6*b* and 6*c* are schematical top plan views of this apparatus, illustrating three successive operating phases thereof;

DESCRIPTION OF THE PREFERRED EMBODIMENTS

Figures 1, 2, 3:
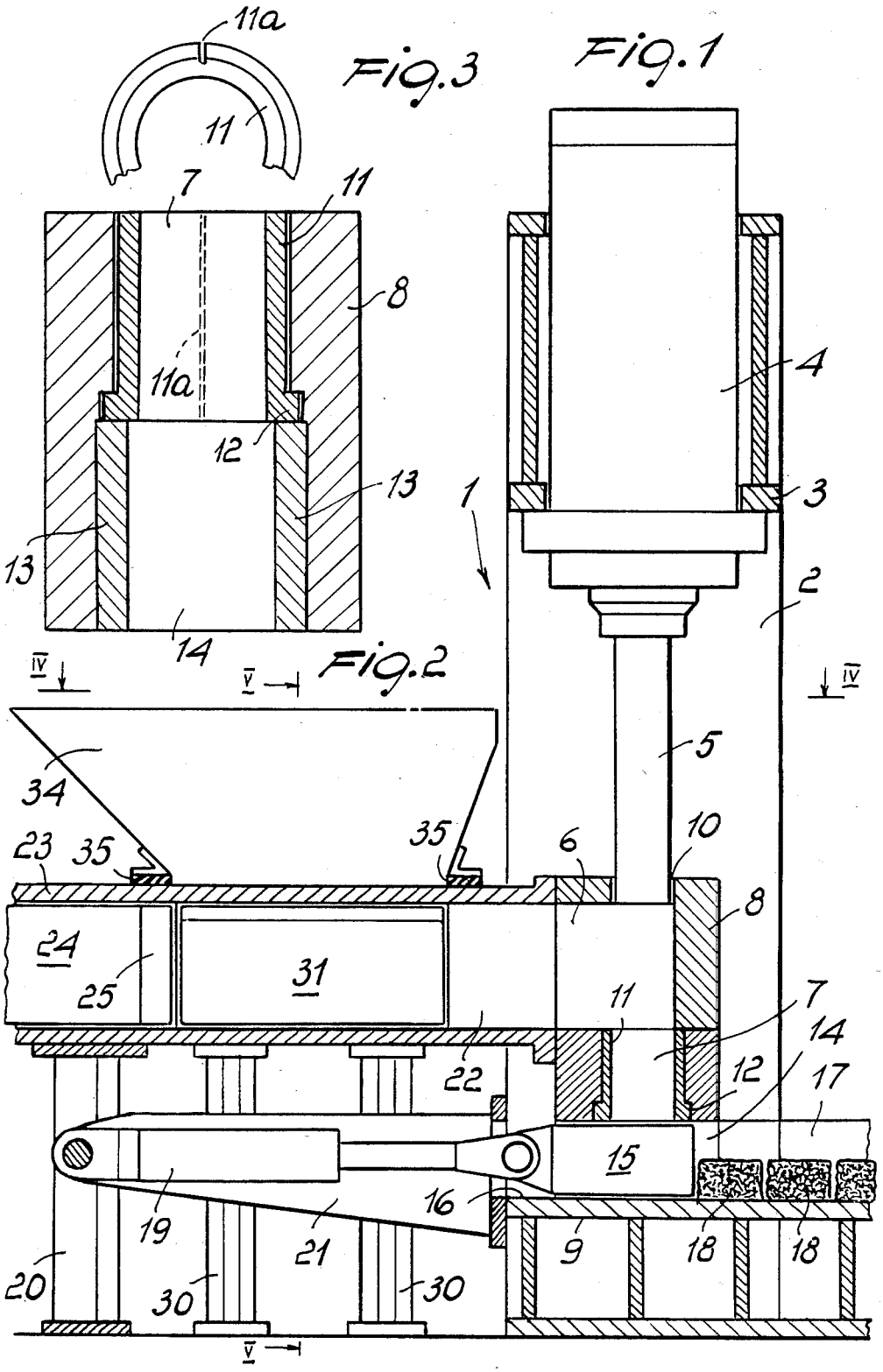
FIG. 1 is a vertical section view of an apparatus according to the invention, taken in a plane through the briquetting machine proper.
FIG. 2 is an axial section view of a die and respective holder, taken in a perpendicular plane to the section plane of FIG. 1, and to an enlarged scale with respect to that of FIG. 1.
FIG. 3 is a fragmentary top plan view of the die.

Making reference first to FIGS. 1 to 5, an apparatus according to this invention, for compacting scrap materials, in particular relatively comminuted scrap metal, chip, waste, and the like, comprises a briquetting machine proper 1 set vertically and having a substantially portal-like configuration, with two uprights 2 and a top crosspiece 3. The crosspiece 3 supports an oil-operated cylinder 4 having a vertical axis, with the piston whereof a compacting ram 5 is made rigid which protrudes vertically from the cylinder 4 and has a preferably circular cross-section.

The ram 5 is adapted to penetrate a feed chamber 6 and a compression chamber 7, which are communicated to each other and placed one on top of the other to form a stacked structure 8 of substantially parallelepipedal shape, carried removably on the bed 9 of the briquetting machine 1. In particular, the feed chamber 6 has a side inlet and a substantially semicylindrical configuration at the remote end from the inlet, the axis and radius of the semicylindrical portion being substantially coincident with the axis and radius of the ram 5. The cross width of the chamber 6 corresponds substantially to the diameter of the ram 5. The ram 5 penetrates the chamber 6 through an opening 10 in the structure 8.

The compression chamber 7 is defined by a substantially cylindrical die 11, arranged in the structure 8 with its vertical axis coincident with the axis of the ram 5 and having a cross-section which substantially corresponds to that of the ram 5. The die 11 is supported, through a flanged base 12, by two parallel supporting cheeks 13 (FIG. 2), which delimit a sliding compartment 14 therebetween for an anvil 15 which is movable in a horizontal direction within said compartment between a closing position and an opening position of the bottom of the compression chamber 7. The width of the compartment 14 only slightly exceeds the inside diameter of the die 11. The anvil 15 is guided on a plane 16 which is extended to form the bottom of a discharge trough 17 for the briquets 18. It is driven by an oil-operated cylinder 19, suitably supported by an upright 20 and side supports 21 attached to the respective uprights 2.

The height of the feed chamber 6 is significantly greater than the height of the compression chamber 7, and hence of the die 11, the latter having a greater height dimension than its inside diameter.

Advantageously, the die 11 is mounted to make a small clearance fit in the structure 8 and has a weakened longitudinal zone by means of an indentation 11*a*, which extends along one generatrix on the die outside and is continued into the flange 12. The reason for this arrangement will be made clear hereinafter.

Associated with the inlet to the feed chamber 6 is the outlet of a pre-compression chamber 22 extending in a horizontal direction and being formed in a box 23 carried on the upright 20 and attached to the structure 8. The chamber 22 accommodates a movable pressure element 24 the front pressure surface 25 whereof has a semicylindrical configuration with a radius substantially corresponding to the radius of the ram 5 and that of the semicylindrical portion of the feed chamber 6, in complementary relationship with this portion. The cross width of the chamber 22 and the height thereof are the same as those of the chamber 6. The pressure element 25 is driven by an oil-operated cylinder 26 attached to the box 23 at 27. As visible in the drawing (FIG. 1) the length of the pre-compression chamber 22 is several times greater than the axial extension of the feed chamber 6.

Into the chamber 22 there opens a further pre-compression chamber 28, laid horizontal perpendicularly to the chamber 22 and being defined in a box 29 which is supported by uprights 30 and attached to the box 23. Within this further pre-compression chamber 28, a pressure element 31 having its front pressure surface flat is movable which is driven by an oil-operated cylinder 32 attached to the box 29. The chamber 28 is provided at the top, at a distance from the chamber 22, with an opening 33 on top of which a loading hopper 34 for the material to be briquetted is placed. Advantageously, the hopper 34 may be supported elastically by supports 35 and be vibrated by a vibrator, not shown, so as to promote a smooth downward movement of the material.

The top horizontal corner edge of the front face of the pressure element 31 is provided with a blade 36 arranged to cooperate with an anvil blade 37 secured, in a slightly slanted direction, to the box 29 at the edge lying below the hopper 34 on the side adjacent the chamber 22.

The apparatus described above operates as follows.

The material, which may be a bulky one even though not a particularly tough one, it comprising for example long aluminum or other light metal chips, city waste, etc., moves down from hopper 34 into the pre-compression chamber 28 (FIG. 6*a*). The pressure element 31, under the action of the fluid in the cylinder 32, urges the material toward the chamber 22. During the stroke of the pressure element 31, the blade 36, in cooperation with the anvil blade 37, will cut off a portion from the material which is compressed into the chamber 22 the pressure element 24 whereof has been fully withdrawn (FIG. 6*b*).

Figures 5, 6D, 6E:
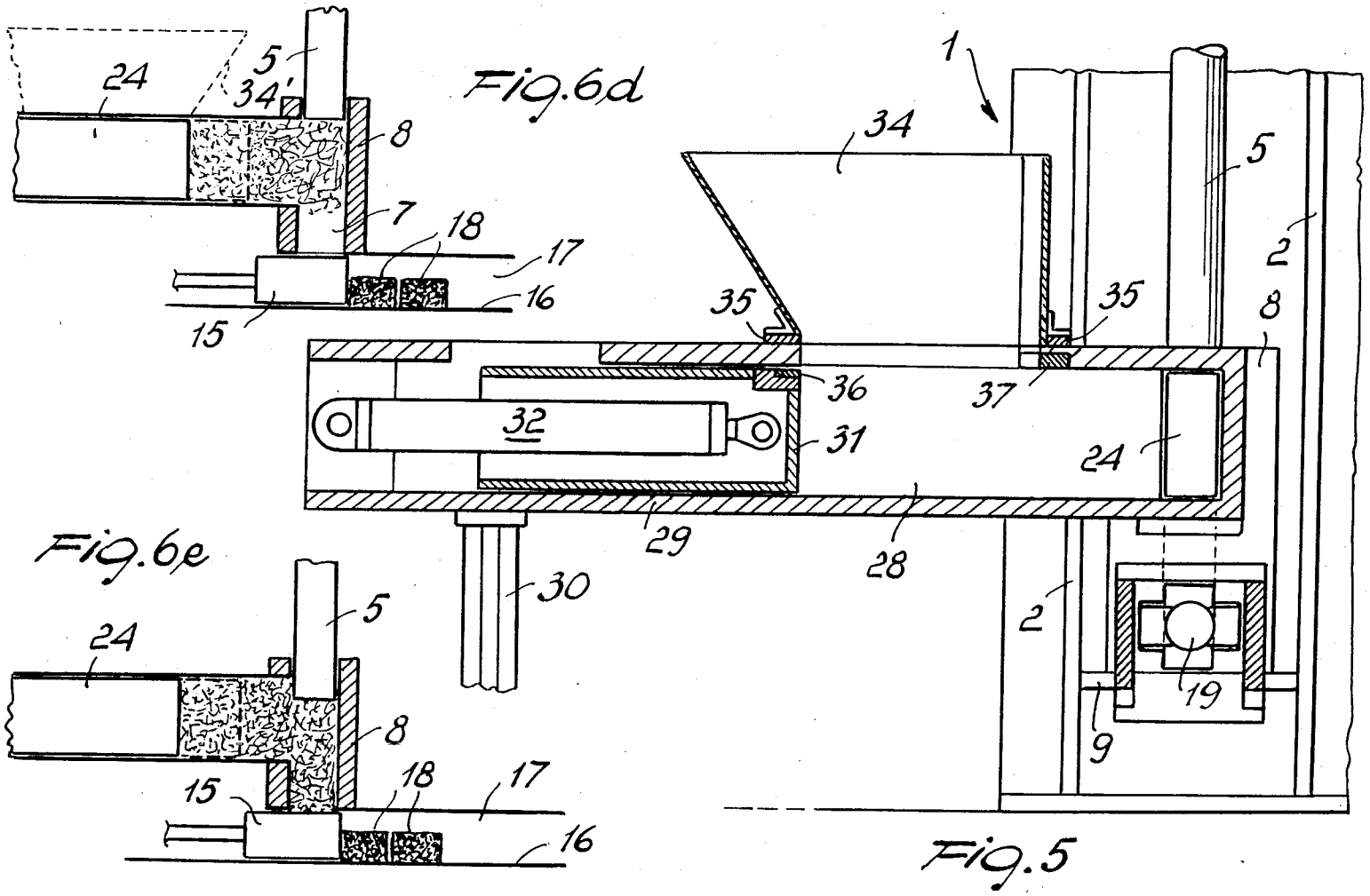
FIG. 5 is a vertical section view of this apparatus, as taken along the line V—V of FIG. 1.
FIGS. 6*d*, 6*e*, 6*f*, and 6*g* are schematical representations of the briquetting zone of this apparatus at four successive times of its operation.

At this point, the pressure element 24 is activated to push the partly pre-compressed material into the feed chamber 6 of the briquetting machine 1 (FIGS. 6*c* and 6*d*). The pressure element 24 does not complete its stroke but only a part of it. The pressure element 31 remains in the position it has reached.

Figures 6F, 6G, 7:
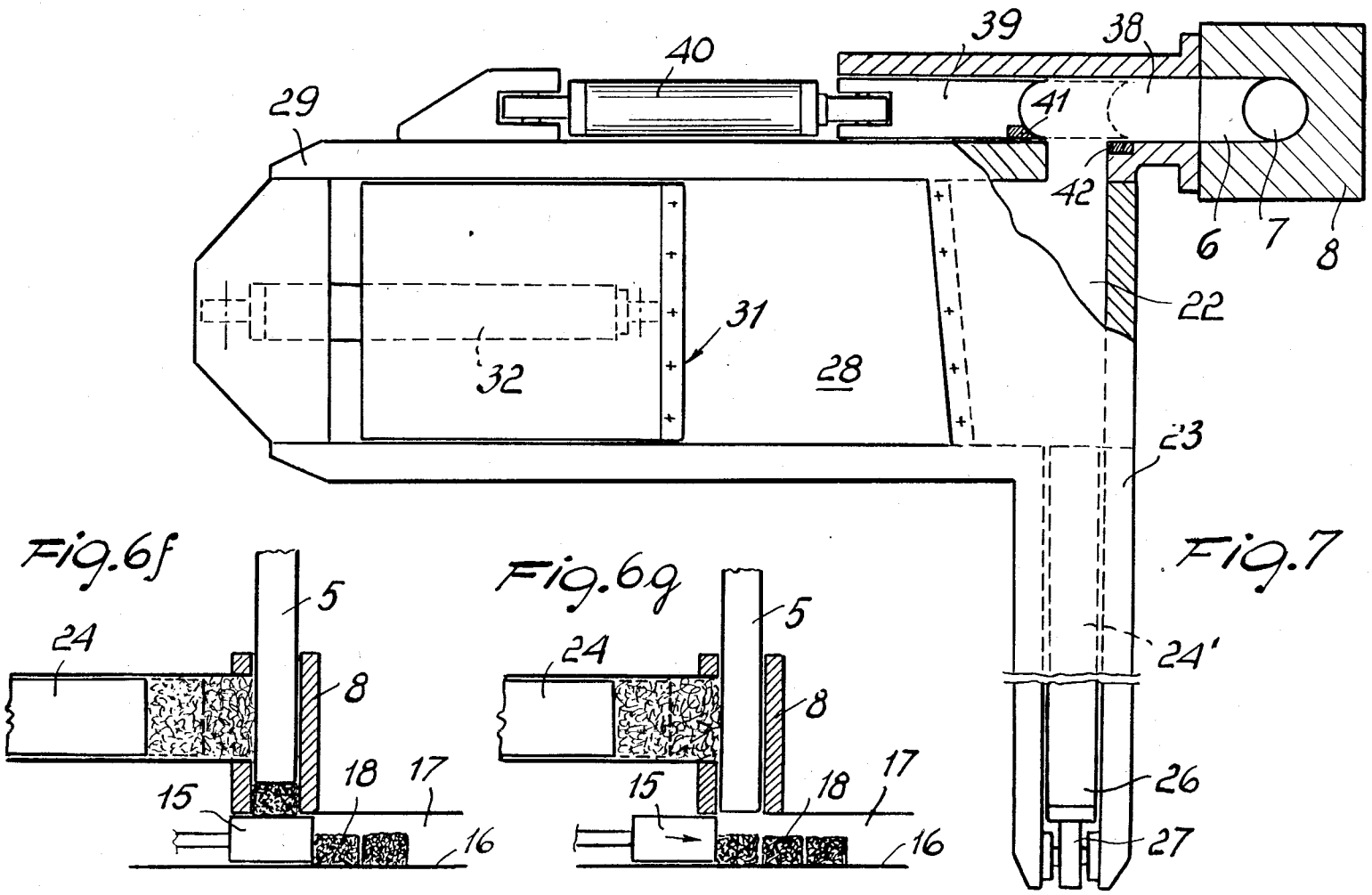
FIG. 7 is a partly sectional top plan view of a further embodiment of the apparatus according to the invention.

Thereafter, the compacting ram 5 of the briquetting machine 1 is dropped, by its own weight, onto the material (FIG. 6*e*), while the anvil 15 keeps the outlet of the compression chamber 7 closed. After this phase, the ram 5 is pushed by the cylinder 4 to compress the material into the die 11 against the anvil 15 at a very high pressure (FIG. 6*f*). The material will thus take the form of a compacted cylindrical slug. On completion of the compression phase, the anvil 15 is withdrawn and the formed briquet ejected by the ram 5 which is again allowed to come down (FIG. 6*g*). Now the ram 5 is returned to the top, into the position shown in FIG. 1, and the anvil 15 is pushed back into its position of closure of the die 11, to push the formed briquet 18 forward.

The cycle is then resumed with the phase of FIGS. 6*c* and 6*d*, in that the pressure element 24 is moved forward by another step, for example to reach the position shown in dotted lines in FIGS. 6c and 6d and introducing fresh material into the feed chamber 6 of the briquetting machine 1. Then, a briquet forming phase takes place anew, and so on, until all the material in the chamber 22 has been exhausted. At that time, both pressure elements 24 and 31 are withdrawn and the cycle is resumed from the start.

It may be appreciated that the pre-compression operations pose no difficulties even with bulky materials, because they are carried out within sufficiently high chambers, and no difficulties are experienced to drive the material each time into the chambers. Further, the provision of shearing means enables the material portions to be compressed to undergo shearing. The material supplied to the briquetting machine 1, therefore, is in a condition that cannot cause any undue wearing of the ram 5 and die 11 resulting from any shearing actions.

During the compression phase, the die 11 is subjected to a radial pressure all around it, and this results in the die being ruptured along the indentation line 11*a*. This rupture affects neither the functionality nor the durability of the die 11. The die, in fact, still receives support from the cheeks 13, and its removal for replacement purposes, where required, is facilitated. To replace the die 11, it will be sufficient to remove the cheeks 13 and push the die 11, which is no force fit in the structure 8, by means of the ram 5 with an intervening washer, into the compartment 14. Thus, the replacement of the die 11 requires no operations or equipment of any complexity.

Shown in FIG. 7 is a further embodiment of an apparatus according to the invention, wherein, between the pre-compression chamber 22 and feed chamber 6, there is interposed a further pre-compression chamber 38 which extends parallel to the chamber 28 and perpendicular to the chamber 22. In this case, the pressure element 24' of the pre-compression chamber 22 has a flat front surface, while in the chamber 38 there is mounted slidably a pressure element 39 with a semicylindrical front surface, similarly to the previous pressure element 24. The pressure element 39 is driven by an oil-operated cylinder 40, carried by the box 29. The pressure element 39, moreover, has a knife blade 41 which extends parallel to the axis of the semicylindrical front surface of the pressure element 39, and during the compression phase cooperates with an anvil blade 42 secured at the outlet from the chamber 22, on the same side as the feed chamber 6. Thus, the pressure element 39 will cut off a portion from the material being supplied from the chamber 22 and compress it into the feed chamber 6, to enable the briquetting machine 1 to effect its briquet-forming cycle at the maximum rate with a minimum of wear. This approach allows processing not only of large and bulky materials, but also of tough ones, such as stainless steel.

It should be appreciated from the foregoing description that, in addition to the cited advantages, and in particular to the elimination of eccentric wear in the briquetting machine thanks to the compression occurring in perfect axial symmetry, this briquetting machine also has a simple construction. The die-holding structure 8 is simply laid onto the base 9 of the briquetting machine 1 and fastened thereto by means of a few screws, so that maintenance can be also made easier. Since the material transfer from the feed chamber 6 to the compression chamber 7 may occur mostly by gravity, prior to the compression proper, no specific means is required to effect that transfer, as is instead provided on conventional briquetting machines in association with the cylinder which controls the compression proper. All this affords undoubtful economical advantages over traditional briquetting machines.

It should be noted that the horizontal displacements of the pressure elements 24 and 31, as well as of the pressure element 39, does not involve wear problems as those due to the weight in prior briquetting machines, since the number of strokes performed by the pressure elements is smaller than that of the ram 5 of the briquetting machine 1, which performs a higher number of compression strokes per load mass pushed in at a single stroke of the first pressure element 31.

The invention as described above is susceptible to many modifications and variations without departing from the true scope of the instant inventive concept. Thus, as an example, a single pre-compression phase could be used by arranging the feed hopper 34 to overlie the chamber 22 as diagrammatically shown in dotted lines and indicated with reference numeral 34' in FIG. 6*d*. Furthermore, the cross-section of the compacting ram 5 and die 11 could be other than the circular one shown. The stroke length of the pressure element 24 could be made adjustable or controlled such as to produce each time a preset pressure force.

I claim:

1. An apparatus for compacting into blocks scrap materials, such as relatively comminuted scrap metal, waste and the like, comprising:

a feed chamber defining member for feeding therein pre-compressed material to be compacted into blocks, said feed chamber having an open ended tubular shape with a substantially vertical feed chamber axis and a side opening with a substantially horizontal feed inlet axis for feeding therethrough said pre-compressed material into said feed chamber, thereby to fill said feed chamber with said pre-compressed material, a compression chamber defining structure located below said feed chamber and having a substantially vertical compression chamber axis coaxially in alignment with said feed chamber axis, said compression chamber defining structure including a tubular open ended die cavity defining die arranged in said structure and at the top of said compression chamber a die inlet opening into said feed chamber and having at the bottom of said compression chamber a die outlet, said die inlet and said die outlet being in coaxial alignment with said compression chamber axis, said compression chamber defining structure comprising further a movable closure element at said die outlet for removably closing said die outlet during compression therein of said pre-compressed material, a compacting ram coaxial with said compression chamber axis and said feed chamber axis and vertically movable along said feed chamber axis and said compression chamber axis from a position above said chamber up to a position at said die outlet thereby to displace said pre-compressed material from said feed chamber into said compression chamber and simultaneously compress terein said pre-compressed material into a compacted block while said closure element is in a position closing said die outlet and expel said compacted block from said compression chamber through said die outlet when said closure element is moved away from said closing position thereof and at least one pre-compression chamber located upstream of said feed chamber and extending substantially horizontally, one said pre-compression chamber being coaxial with said feed inlet axis and opening into said side opening of said feed chamber, each said pre-compression chamber having a pressure element axially movable therethrough for partially pressing and displacing said pre-compressed material.

2. An apparatus according to claim 1, wherein said die has a substantially cylindrical shape and a flanged base at said die outlet and wherein said compression chamber defining structure includes cheek members below said flanged base for delimiting a horizontal sliding motion compartment for said closure element, said flanged base resting on said cheek members said closure element being in the form of an horizontally movable anvil member.

3. An apparatus according to claim 2, further comprising a discharge trough, said compartment extending into said discharge trough.

4. An apparatus according to claim 2, wherein said die is received in said structure with a slight clearance fit.

5. An apparatus according to claim 2, wherein said die has a weakened longitudinal zone defined by an indentation on the outer surface thereof, said indentation extending along one generatrix line of said die and said flanged base thereof, said indentation being such as to result in rupture of the die during the material compression phase.

6. An apparatus according to claim 2, comprising three said pre-compression chambers, each said chambers being perpendicular to the adjacent one.

7. An apparatus according to claim 1, wherein the height of said feed chamber is significantly greater than the height of said die, said die having a height greater than the inside diameter thereof.

8. An apparatus according to claim 1, comprising two said pre-compression chambers arranged in succession to each other and perpendicularly to each other.

9. An apparatus according to claim 1, wherein one of said pre-compression chambers has a pressure element with a front surface, said front surface having a knife blade extending transverse to said one pre-compression chamber.

10. An apparatus according to claim 1, wherein said one pre-compression chamber has a height equal to the axial extension of said feed chamber and said one pre-compression chamber and said feed chamber each having a cross width, the cross width of said one pre-compression chamber having the same size as the cross width of said feed chamber, said one pre-compression chamber having an axial extension several times greater than the axial extension of said feed chamber, thereby to repeatedly fill said feed chamber with pre-compressed material with repeated displacement of pre-compressed material towards said feed chamber without recharging said feed chamber.

11. An apparatus for compacting into blocks scrap materials, such as relatively comminuted scrap metal, waste and the like, comprising:

a feed chamber defining member for feeding therein pre-compressed material to be compacted into blocks, said feed chamber having an open ended cylindrical shape with a substantially vertical feed chamber axis and a side opening with a substantially horizontal feed inlet axis for feeding therethrough said pre-compressed material into said feed chamber, thereby to fill said feed chamber with said pre-compressed material, a compression chamber defining structure located below said feed chamber and having a substantially vertical compression chamber axis coaxially in alignment with said feed chamber axis, said compression chamber defining structure including a cylindrical open ended die cavity defining die removably arranged in said structure and at the top of said compression chamber a die inlet opening into said feed chamber and having at the bottom of said compression chamber a die outlet, said die inlet and said die outlet being in coaxial alignment with said compression chamber axis, said compression chamber defining structure comprising further a movable closure element at said die outlet for removably closing said die outlet during compression therein of said pre-compressed material, said feed chamber and said die cavity having cylindrical internal surfaces in flush alignment with respect to each other, a basement below said structure, said structure and said feed chamber defining member being arranged in stacked relationship to each other and removably supported on said basement, a compacting ram coaxial with said compression chamber axis and said feed chamber axis and vertically movable along said feed chamber axis and said compression chamber axis from a position above said chamber up to a position at said die outlet thereby to displace said pre-compressed material from said feed chamber into said compression chamber and simultaneously compress therein said pre-compressed material into a compacted block while said closure element is in a position closing said die outlet and expel said compacted block from said compression chamber through said die outlet when said closure element is moved away from said closing position thereof and at least one pre-compression chamber located upstream of said feed chamber and extending substantially horizontally, one said pre-compression chamber being coaxial with said feed inlet axis and opening into said side opening of said feed chamber, each said pre-compression chamber having a pressure element axially movable therethrough for partially pressing and displacing said pre-compressed material.

12. An apparatus according to claim 11, wherein said die has a flanged base at said die outlet and wherein said compression chamber defining structure includes cheek members below said flanged base for delimiting a horizontal sliding motion compartment for said closure element, said flanged base resting on said cheek members, said closure element being in the form of an horizontally movable anvil member.

13. An apparatus according to claim 12, further comprising a discharge trough, said compartment extending into said discharge trough.

14. An apparatus according to claim 12, wherein said die is received in said structure with a slight clearance fit.

15. An apparatus according to claim 12, wherein said die has a weakened longitudinal zone defined by an indentation on the outer surface thereof, said indentation extending along one generatrix line of said die and said flanged base thereof, said indentation being such as to result in rupture of the die during the material compression phase.

16. An apparatus according to claim 12, comprising three said pre-compression chambers, each said chambers being perpendicular to the adjacent one.

17. An apparatus accoding to claim 11, wherein the height of said feed chamber is significantly greater than the height of said die, said die having a height greater than the inside diameter thereof.

18. An apparatus accoding to claim 11, comprising two said pre-compression chambers arranged in succession to each other and perpendicularly to each other.

19. An apparatus according to claim 11, wherein one of said pre-compression chambers has a pressure element with a front surface, said front surface having a knife blade extending transverse to said one pre-compression chamber.

20. An apparatus according to claim 11, wherein said one pre-compression chamber has a height equal to the axial extension of said feed chamber and said one pre-compression chamber and said feet chamber each having a cross width, the cross width of said one pre-compression chamber having the same size as the cross width of said feed chamber, said one pre-compression chamber having an axial extension several times greater than the axial extension of said feed chamber, thereby to repeatedly fill said feed chamber with pre-compressed material with repeated displacement of pre-compressed material towards said feed chamber without recharging said feed chamber.

* * * * *